US006340663B1

(12) United States Patent
Deleo et al.

(10) Patent No.: US 6,340,663 B1
(45) Date of Patent: Jan. 22, 2002

(54) CLEANING WIPES

(75) Inventors: Malcolm A. Deleo, Castro Valley; Robert L. Blum, Clayton; Maria G. Ochomogo, Danville; Paul A. Pappalardo; Elizabeth N. Swayne, both of Livermore, all of CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 09/448,703

(22) Filed: Nov. 24, 1999

(51) Int. Cl.[7] ..... C11D 17/04; C11D 3/22; C11D 3/37; B08B 7/00

(52) U.S. Cl. ..... 510/438; 510/439; 510/108; 510/238; 510/470; 510/475; 510/477; 134/42

(58) Field of Search ..... 510/438, 439, 510/108, 238, 470, 475, 477; 134/42

(56) References Cited

U.S. PATENT DOCUMENTS

| | | | | | |
|---|---|---|---|---|---|
| 4,606,842 | A | | 8/1986 | Kayes et al. | 252/174.23 |
| 4,615,937 | A | | 10/1986 | Bouchette | 428/288 |
| 4,627,931 | A | | 12/1986 | Malik | 252/153 |
| 4,666,621 | A | | 5/1987 | Clark et al. | 252/91 |
| 4,741,944 | A | * | 5/1988 | Jackson et al. | 728/152 |
| 4,781,974 | A | | 11/1988 | Bouchette et al. | 428/288 |
| 5,126,068 | A | | 6/1992 | Burke et al. | 252/174.21 |
| 5,342,534 | A | * | 8/1994 | Skrobala et al. | 252/91 |
| 5,514,369 | A | | 5/1996 | Salka et al. | 424/70.1 |
| 5,763,332 | A | * | 6/1998 | Gordon et al. | 442/84 |
| 5,863,663 | A | * | 1/1999 | Mackey et al. | 428/486 |
| 5,908,707 | A | | 6/1999 | Cabell et al. | 428/537.5 |
| 5,914,177 | A | * | 6/1999 | Smith, III et al. | 428/195 |
| 5,980,922 | A | * | 11/1999 | Mackey et al. | 424/402 |

FOREIGN PATENT DOCUMENTS

| | | | | |
|---|---|---|---|---|
| EP | 0377500 | * | 7/1990 | |
| EP | 0750063 | | 12/1996 | D04H/1/46 |
| JP | 10-8090 | | 1/1998 | C11D/1/831 |
| WO | WO 96/14835 | | 5/1996 | A61K/9/70 |
| WO | WO 97/25106 | | 7/1997 | A62D/3/09 |
| WO | WO 97/25404 | | 7/1997 | C11D/7/18 |
| WO | WO 97/40814 | | 11/1997 | A61K/7/50 |
| WO | WO 98/03713 | | 1/1998 | D04H/13/00 |
| WO | 98/26040 | * | 6/1998 | |

* cited by examiner

*Primary Examiner*—Lorna M. Douyon
(74) *Attorney, Agent, or Firm*—Joel J. Hayashida

(57) ABSTRACT

The invention provides an improved cleaning wipe which requires no scrubbing, buffing, polishing or rinsing, with the following components:

(a) a wipe which comprises at least one layer of absorbent/adsorbent material;

(b) a liquid cleaner which comprises
(i) a low residue surfactant;
(ii) a hydrophilic polymer; and
(iii) the remainder, water.

11 Claims, No Drawings

CLEANING WIPES

FIELD OF THE INVENTION

The present invention relates to an improved general purpose cleaning wipe which comprises a wipe combined with a liquid solution comprising surfactant and a hydrophilic polymer. The improved wipe surprisingly accomplishes the desired but difficult-to-achieve goals of enhanced cleaning, with little or no filming or streaking, without buffing the surface cleaned with the wipe.

BACKGROUND OF THE INVENTION

Cleaning wipes have been formulated for specific purposes. For example, cleaning wipes containing inverse emulsions (i.e., water-in-lipid) are particularly useful in removing perianal soils from infants. These baby wipes are claimed to be more aesthetically pleasant to use on skin, since they essentially contain a waxy coating which, among other characteristics, prevents premature release of the aqueous liquid cleaning composition contained in the inverse emulsion. Examples of these inverse emulsion impregnated wipes are depicted in Cabell et al., U.S. Pat. No. 5,908,707, Mackey et al., WO 97/40814, Mackey et al., WO 96/14835 and Moore, EP 750063. It is quite clear that these types of wipes do not consider improved cleaning of hard surfaces as paramount.

Clark et al., U.S. Pat. No. 4,666,621, discloses pretreating a nonwoven substrate (essentially, a sheet laminated from wood pulp and polyester) with a low level of acrylic polymer emulsion, which is allowed to cure. Thereafter, the impregnated sheet is moistened with alcohol, surfactant and demineralized water. It is quite clear that the function of the acrylic polymer emulsion is to function as a binder for the sheet, since the patent admits that the use thereof is critical " . . . to suppress linting (of the sheet) during a cleaning operation." (Clark et al., column 4, lines 3–4). However, the polymer does not function as a cleaning active in the cleaning wipe of Clark.

Other references disclose the use of glycoside surfactants in hard surface cleaners (e.g., Malik, U.S. Pat. No. 4,627,931 and Maekawa et al., JP Heisei 10 (1998)-8090), but do not mention that these types of surfactants can be loaded onto cleaning wipes, and, most importantly are not combined with hydrophilic polymers in a cleaning solution before being loaded onto cleaning wipes.

Salka et al., U.S. Pat. No. 5,514,369, disclose foaming shampoo compositions comprising glycoside surfactant, betaine, amine oxide and a "slip agent," which could be a polyacrylate, such as acrylamidomethylpropanesulfonic acid (Cosmedia HSP-1180, from Henkel Corp.). As shampoos, the concentrations of the ingredients are relatively high (at least 7% total surfactants) and plainly, the formulations are meant to be viscous, pearlescent liquids, which are unsuitable for cleaning hard surfaces and, especially, are not intended to be loaded onto wipes.

Thus, none of the related art teach, disclosure or suggest an improved cleaning wipe impregnated with a liquid cleaner comprising a glycoside nonionic surfactant and a hydrophilic polymer. Additionally, such related art does not teach, disclose or suggest the advantages and benefits of the inventive cleaning wipe.

SUMMARY OF THE INVENTION

The present invention is directed to an improved cleaning wipe impregnated with a liquid cleaning composition in which a hydrophilic polymer, a surfactant, optionally, at least one solvent and water are combined to provide enhanced cleaning of hard surfaces, without the need for rinsing with water, and in which not only is complete cleaning effected, but done so without the leaving of a significant residue, which is typically called streaking/filming. Surfaces treated with the wipes, especially glossy hard surfaces, such as glass, mirrors, chrome, tile, shiny metallic surfaces, painted surfaces, porcelain (or other hard, glossy surfaces, whether made of natural or composite materials), and the like, are rendered brighter and shinier in appearance.

In one aspect, the invention is directed to a cleaning wipe which requires no scrubbing, buffing, polishing or rinsing, comprising:

(a) a wipe which preferably comprises at least one layer of nonwoven material;

(b) a liquid cleaner which comprises:

(i) a surfactant;

(ii) a hydrophilic polymer; and (iii) the remainder, water, said wipe used to clean surfaces without rinsing, streaking or filming.

In another aspect, the invention is directed to a cleaning wipe as just described in which the liquid cleaner also contains at least one water-soluble or dispersible organic solvent having a vapor pressure of at least 0.001 mm Hg at 25° C., said at least one organic solvent present in an amount effective to help solubilize or disperse the surfactant and/or hydrophilic polymer into the aqueous phase.

In yet another aspect, the invention is directed to a method for cleaning a hard surface, comprising the steps of:

applying to the surface a cleaning wipe combined with a discrete amount of liquid cleaner, said liquid cleaner comprising:

(i) a surfactant;

(ii) a hydrophilic polymer; and (iii) the remainder, water, whereby the surfaces are cleaned without the need for scrubbing, wiping, or immediate rinsing, and are free from streaking and filming.

It is therefore an object and an advantage of the present invention to provide a cleaning wipe impregnated with a liquid cleaner which contains a low residue surfactant, preferably such as a glycoside, to greatly improve the streaking and filming performance of such a wipe.

It is another object and another advantage of the present invention to provide a cleaning wipe impregnated with a liquid cleaner in which one of the ingredients thereof is a hydrophilic polymer, at least one of whose purposes is to promote improved streaking/filming on a surface cleaned with said wipe.

It is yet another object and yet another advantage of the present invention to provide a cleaning wipe which has low to no streaking and filming.

It is still a further object and still a further advantage of the present invention to provide a consumer convenient cleaning means which cleans surfaces without the need to rinse with water.

It is another object and a further advantage of the present invention to provide a cleaning wipe which cleans hard surfaces and, especially with respect to glossy surfaces, leaves the surface clean, bright and shiny.

DETAILED DESCRIPTION OF THE INVENTION

The invention provides an improved cleaning wipe comprising an absorbent/adsorbent wipe, preferably made of at least one layer of nonwoven material, the wipe being impregnated with a liquid cleaner. The wipe provides excellent cleaning with no or little streaking/filming and imparts resistance to soiling to the surface cleaned therewith.

The cleaning wipe is preferably impregnated with a liquid cleaner which preferably is a single phase solution or dispersion, having a viscosity generally less than about 1,000 Centipoise ("cps"). The liquid cleaner has the following ingredients:

(i) a surfactant;

(ii) a hydrophilic polymer; and (iii) the remainder, water.

Preferably, at least one water-soluble or dispersible organic solvent having a vapor pressure of at least 0.001 mm Hg at 25° C. and present in a solubilizing- or dispersion-effective amount may be incorporated into the liquid cleaner.

Additional adjuncts in small amounts such as cosurfactants, chelating agents, buffers, fragrances, dyes, and the like can be included to provide desirable attributes of such adjuncts.

In the application, effective amounts are generally those amounts listed as the ranges or levels of ingredients in the descriptions which follow hereto. Unless otherwise stated, amounts listed in percentage ("%'s") are in weight percent (based on 100% active) of the cleaning composition.

1. The Substrate

The substrate for the wipe is generally an absorbent or adsorbent material. Preferably, it is a nonwoven sheet, which is at least one layer, made of wood pulp; or a blend of wood pulp and a synthetic fiber, without limitation, such as polyester, rayon, nylon, polypropylene, polyethylene, other cellulose polymers; or a synthetic fiber or mixture of such fibers. The nonwovens may include nonwoven fibrous sheet materials which include meltblown, coform, air-laid, spun bond, wet laid, bonded-carded web materials, hydroentangled (also known as spunlaced) materials, and combinations thereof. These materials can comprise synthetic or natural fibers or combinations thereof. A binder may or may not be present. Manufacturers include Kimberly-Clark, E.I. du Pont de Nemours and Company, Dexter, American Nonwovens, James River, BBA Nonwovens and PGI. Examples of such substrates are depicted in: Bouchette et al., U.S. Pat. Nos. 4,781,974 and 4,615,937, Clark et al., U.S. Pat. No. 4,666,621, Amundson et al., WO 98/03713, and Cabell et al., U.S. Pat. No. 5,908,707, Mackey et al., WO 97/40814, Mackey et al., WO 96/14835 and Moore, EP 750063, all of which are incorporated herein by reference.

Woven materials, such as cotton fibers, cotton/nylon blends, or other textiles may also be used herein. Regenerated cellulose, polyurethane foams, and the like, which are used in making sponges, may also be suitable for use herein.

The substrate's liquid loading capacity should be at least about 50%–1000% of the dry weight thereof, most preferably at least about 200%–800%. This is expressed as loading ½ to 10 times the weight (or, more accurately, the mass) of the substrate.

The substrate varies without limitation from about 0.01 to about 1,000 grams per square meter, most preferably 25 to 120 grams/$m^2$ (referred to as "basis weight") and typically is produced as a sheet or web which is cut, die-cut, or otherwise sized into the appropriate shape and size.

The substrates, which are now referred to simply as wipes, can be individually sealed with a heat-sealable or glueable thermoplastic overwrap (such as polyethylene, Mylar, and the like). More preferably the wipes can be packaged as numerous, individual sheets which are then impregnated or contacted with the liquid cleaning ingredients of the invention for more economical dispensing. Even more preferably, the wipes can be formed as a continuous web during the manufacturing process and loaded into a dispenser, such as a canister with a closure, or a tub with closure. The closure is to seal the moist wipes from the external environment and to prevent premature volatilization of the liquid ingredients. Without limitation, the dispenser may be formed of plastic, such as high density polyethylene, polypropylene, polycarbonate, polyethylene pterethalate (PET), polyvinyl chloride (PVC), or other rigid plastics. The continuous web of wipes could preferably be threaded through a thin opening in the top of the dispenser, most preferably, through the closure. A means of sizing the desired length or size of the wipe from the web would then be needed. A knife blade, serrated edge, or other means of cutting the web to desired size can be provided on the top of the dispenser, for non-limiting example, with the thin opening actually doubling in duty as a cutting edge. Alternatively, the continuous web of wipes could be scored, folded, segmented, or partially cut into uniform or non-uniform sizes or lengths, which would then obviate the need for a sharp cutting edge. Further, as in hand tissues, the wipes could be interleaved, so that the removal of one wipe advances the next, and so forth.

The wipes will preferably have a certain wet tensile strength which is without limitation about 25 to about 250 Newtons/m, more preferably about 75–170 Newtons/m.

2. The Liquid Cleaner

The liquid cleaner is impregnated, dosed, loaded, metered, or otherwise dispensed onto the wipe. This can be executed in numerous ways. For example, each individual wipe could be treated with a discrete amount of liquid cleaner. More preferably, a mass treatment of a continuous web of wipes with the liquid cleaner will ensue. In some cases, an entire web of wipes could be soaked in the cleaner. In other cases, while the web is being spooled, or even during the creation of the nonwoven material, the liquid cleaner could be sprayed or otherwise metered onto the web. A mass, such as a stack of individually cut and sized wipes could also be impregnated in its container by the manufacturer, or, even by the user. What follows is a description of the individual constituents of the liquid cleaner.

3. Surfactants

An essential part of the invention lies in the use of a low residue surfactant, of which especially preferred is a glycoside, as the major surfactant portion of the liquid cleaner used to impregnate the wipe. Particularly preferred are the alkyl polyglycosides. The preferred glycosides include those of the formula:

$$RO(C_nH_{2n}O)_y(Z)_x$$

wherein R is a hydrophobic group (e.g., alkyl, aryl, alkylaryl etc., including branched or unbranched, saturated and unsaturated, and hydroxylated or alkoxylated members of the foregoing, among other possibilities) containing from about 6 to about 30 carbon atoms, preferably from about 8 to about 16 carbon atoms, and more preferably from about 8 to about 12 carbon atoms; n is a number from 2 to about 4, preferably 2 (thereby giving corresponding units such as ethylene, propylene and butylene oxide); y is a number having an average value of from 0 to about 12, preferably 0; Z is a moiety derived from a reducing saccharide containing 5 or 6 carbon atoms (e.g., a glucose, fructose, mannose, galactose, talose, gulose, allose, altrose, idose, arabinose, xylose, lyxose, or ribose unit, etc., but most preferably a glucose unit); and x is a number having an average value of from 1 to about 10, preferably from 1 to about 5, and more preferably from 1 to about 3. In actual practice, R may be a mixture of carbon chains, for instance, from 8 to 16 carbon atoms and Z may be a mixture of saccharide units from 0 to 6.

It would be apparent that a number of variations with respect to the makeup of the glycosides are possible. For example, mixtures of saccharide moieties (Z) may be incorporated into polyglycosides. Also, the hydrophobic group (R) can be attached at the 2-, 3-, or 4-positions of a saccharide moiety rather than at the 1-position (thus giving, for example, a glucosyl as opposed to a glucoside). In addition, normally free hydroxyl groups of the saccharide moiety may be alkoxylated or polyalkoxylated. Further, the $(C_nH_{2n}O)_y$ group may include ethylene oxide and propylene oxide in random or block combinations, among a number of other possible variations.

Non-limiting examples of glycoside surfactants include Glucopon 225 (a mixture of $C_8$ and $C_{10}$ chains equivalent to an average of $C_{9.1}$, with x of the general formula above of 1.7, and an HLB of 13.6; Glucopon 220 (a mixture of $C_8$ and $C_{10}$ chains equivalent to an average of $C_{9.1}$, with x of the general formula above of 1.5, and an HLB of 13.5; Glucopon 325 (a mixture of $C_8$, $C_{10}$, $C_{12}$, $C_{14}$, and $C_{16}$ chains equivalent to an average of $C_{10.2}$, with x of the general formula above of 1.6, and an HLB of 13.1; Glucopon 625 (a mixture of $C_{12}$, $C_{14}$, and $C_{16}$ chains equivalent to an average of $C_{12.8}$, with x of the general formula above of 1.60, and an HLB of 12.1; and Glucopon 600 (a mixture of $C_{12}$, $C_{14}$, and $C_{16}$ chains equivalent to an average of $C_{12.8}$, with x of the general formula above of 1.40, and an HLB of 11.5, all manufactured by the Henkel Corporation. Of these, Glucopon 225 and Glucopon 220 are preferred and Glucopon 425 is especially preferred. Glucosides from other manufacturers, such as Triton CG-110, having an HLB of 13.6 and manufactured by Union Carbide also may serve as examples of suitable surfactants.

Glucoside surfactants are frequently supplied as mixtures with other surfactants. For example, mixtures with the anionic surfactants, lauryl sulfate or laurylether sulfate, or the amphoteric surfactants, cocamidopropylbetaine or cocamidopropyl amineoxide, are available from the Henkel Corporation.

The amounts of surfactants present are to be somewhat minimized, for purposes of cost-savings and to generally restrict the dissolved actives which could contribute to leaving behind residues when the composition is applied to a surface. However, the amounts added are generally about 0.001–6%, more preferably 0.002–4.00% surfactant. These are generally considered to be cleaning-effective amounts.

4. Cosurfactants

Although the disclosed glycosides of the invention provide excellent cleaning performance, as shown in the examples which follow, it may sometimes be desired to add small amounts of cosurfactants to the formulations to obtain additional cleaning benefits. The glycoside surfactant may be used in conjunction with any of the other nonionic, anionic, cationic or amphoteric surfactants, or mixtures thereof, such as are known in the art. Such surfactants are described, for example, in *McCutcheon's Emulsifiers and Detergents* (1997), the contents of which are hereby incorporated by reference.

Illustrative nonionic surfactants are the ethylene oxide and mixed ethylene oxide/propylene oxide adducts of alkylphenols, the ethylene oxide and mixed ethylene oxide/propylene oxide adducts of long chain alcohols or of fatty acids, mixed ethylene oxide/propylene oxide block copolymers, esters of fatty acids and hydrophilic alcohols, such as sorbitan monooleate, alkanolamides, and the like.

Illustrative anionic surfactants are the soaps, alkylbenzene sulfonates, olefin sulfonates, paraffin sulfonates, alcohol and alcohol ether sulfates, phosphate esters, and the like.

Illustrative cationic surfactants include amines, amine oxides, alkylamine ethoxylates, ethylenediamine alkoxylates such as the Tetronic® series from BASF, quaternary ammonium salts, and the like.

Illustrative amphoteric surfactants are those which have both acidic and basic groups in their structure, such as amino and carboxyl radicals or amino and sulfonic radicals, or amine oxides and the like. Suitable amphoteric surfactants include betaines, sulfobetaines, imidazolines, and the like.

The amounts of cosurfactants will generally be about less than the level of the primary low residue surfactant, such as preferably glycoside.

5. Polymers

The polymer is generally speaking a water soluble to dispersible polymer having a molecular weight of generally below 2,000,000 daltons. Preferably, the polymer will also not itself have an obvious or offensive odor, although that attribute can be mitigated by judicious selection of fragrance.

Examples of suitable classes of polymers include:

a. Polysaccharides

Suitable polymers may comprise polysaccharide polymers, which include substituted cellulose materials like carboxymethylcellulose, ethyl cellulose, hydroxyethylcellulose, hydroxypropylcellulose, hydroxymethylcellulose, succinoglycan and naturally occurring polysaccharide polymers like xanthan gum, guar gum, locust bean gum, tragacanth gum or derivatives thereof. Particularly useful polysaccharides are xanthan gum and derivatives thereof. Some of these are thickeners which may have too much tack, from a performance and aesthetic standpoint. Additional suitable polysaccharide polymers may include sodium caseinate and gelatin. Other suitable polysaccharide polymers may include cationic derivatives, such as the cationic cellulose ether, Polymer JR.

b. Polycarboxylates

Polycarboxylates can also be used which contain amounts of nonionizable monomers, such as ethylene and other simple olefins, styrene, alpha-methylstyrene, methyl, ethyl and C3 to C8 alkyl acrylates and methacrylates, isobornyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates. Other suitable polymers include other polycarboxylates, such as homopolymers and copolymers of monomeric units selected FROM the group consisting of unsaturated carboxylic acids such as acrylic acid, methacrylic acid, polycarboxylic acids, sulfonic acids, phosphonic acids and mixtures thereof. Copolymerization of the above monomeric units among them or with other co-monomers such as maleic anhydride, ethylene or propylene are also suitable.

c. Acrylate Polymers

Other suitable polymers are acrylic emulsion. These are generally copolymers of one or more acidic monomers, such as acrylic acid, methacrylic acid or maleic anhydride, with at least one other ethylenically unsaturated monomer selected from a group consisting of ethylene and other simple olefins, styrene, alpha-methylstyrene, methyl, ethyl and $C_3$ to $C_8$ alkyl acrylates and methacrylates, isobomyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates, fumaric acid, maleic acid, itaconic acid, and the like. It is also frequently desirable to include minor amounts of other functional monomers, such as acetoacetoxy methacrylate or other acetoacetate monomers and divinyl or polyvinyl monomers, such as glycol polyacrylates, allyl methacrylate, divinyl benzene and the like. The preferred polymers have a number average molecular weight of about 500 to about 2,000,000. These polymers may also be crosslinked with metal ions or modified for crosslinking with silane functionally as described, for example, in U.S. Pat. No. 5,428,107. Examples of such acrylic emulsion polymers include those available under the Rhoplex tradename from Rohm & Haas, such as Rhoplex AC-33, Rhoplex B-924, and Rhoplex MC-76. There are also polymers from Alco, such as Balance CR, Balance 47 and Balance 055. Additionally, there are acrylates from Rohm and Haas, namely, Acusol, such as Acusol 445, and the like. See also Keyes et al., U.S. Pat. No. 4,606,842, incorporated herein by reference. Other suitable polymers are copolymers of acrylic and/or methacrylic acid with acrylate and methacrylate esters. For example, a copolymer of 51% methyl methacrylate, 31% butyl acrylate, and 18% acrylic acid is available from Rohm & Haas as Emulsion Polymer E-1250.

Other suitable polymers may include cationic acrylic water soluble polymers that are copolymers of cationic quaternized acrylates, methacrylates, acrylamides, and methacrylamides, for example trimethylammoniumpropylmethacrylate, and acrylamide or acrylonitrile.

f. Polyvinylpyrrolidones

Other suitable polymers include vinylpyrrolidone homopolymers and copolymaers. Suitable vinylpyrrolidone homopolymers have an average molecular weight of from 1,000 to 100,000,000, preferably from 2,000 to 10,000,000, more preferably from 5,000 to 1,000,000, and most preferably from 30,000 to 700,000. Suitable vinyl pyrrolidone homopolymers are commercially available from ISP Corporation, Wayne, N.J. under the product names PVP K-15 (average molecular weight of 8,000), PVP K30 (average molecular weight of 38,000), PVP K-60 (average molecular weight of 216,000), PVP K-90 (average molecular weight of 630,000), and PVP K-120 (average molecular weight of 2,900,000). Suitable copolymers of vinylpyrrolidone include copolymers of N-vinylpyrrolidone with one or more alkylenically unsaturated monomers. Suitable alkylenically unsaturated monomers include unsaturated dicarboxylic acids such as maleic acid, chloromaleic acid, fumaric acid, itaconic acid, citraconic acid, phenylmaleic acid, aconitic acid, acrylic acid, methacrylic acid, N-vinylimidazole, vinylcaprolactam, butene, hexadecene, and vinyl acetate. Any of the esters and amides of the unsaturated acids may be employed, for example, methyl acrylate, ethylacrylate, acrylamide, methacryamide, dimethylaminoethylmethacrylate, dimethylaminopropylmethacrylamide, trimethylammoniumethylmethacrylate, and trimethylammoniumpropylmethacrylamide. Other suitable alkylenically unsaturated monomers include aromatic monomers such as styrene, sulphonated styrene, alpha-methylstyrene, vinyltoluene, t-butylstyrene and others. Copolymers of vinylpyrrolidone with vinyl acetate are commercially available under the trade name PVP/VA from ISP Corporation. Copolymers of vinylpyrrolidone with alpha-olefins are available, for example, as P-904 from ISP Corporation. Copolymers of vinylpyrrolidone with dimethylaminoethylmethacrylate are available, for example, as Copolymer 958 from ISP Corporation. Copolymers of vinylpyrrolidone with trimethylammoniumethylmethacrylate are available, for example, as Gafquat 734 from ISP Corporation. Copolymers of vinylpyrrolidone with trimethylammoniumpropylmethacrylamide are available, for example, as Gafquat HS-100 from ISP Corporation. Copolymers of vinylpyrrolidone with styrene are available, for example, as Polectron 430 from ISP Corporation. Copolymers of vinylpyrrolidone with acrylic acid are available, for example, as Polymer ACP 1005 (25% vinylpyrrolidone/75% acrylic acid) from ISP Corporation.

e. Methylvinyl Ether

Other suitable polymers include methylvinylether homopolymers and copolymers. Preferred copolymers are those with maleic anhydride. These copolymers can be hydrolyzed to the diacid or derivatized as the monoalkyl ester. For example, the n-butyl ester is available as Gantrez ES-425 from ISP Corporation.

f. Polyvinyl alcohols

Other suitable polymers include polyvinyl alcohols. Preferably, polyvinyl alcohols which are at least 80.0%, preferably 88–99.9%, and most preferably 99.0–99.8% hydrolyzed are used. For example, the polyvinyl alcohol, Elvanol 71-30 is available from E. I. DuPont de Nemours and Company, Wilmington, Del.

g. Polyethylene Glycols

Yet other feasible polymers are polyethylene glycols, such as disclosed in Baker et al., U.S. Pat. No. 4,690,779, incorporated herein by reference.

Mixtures of any of the foregoing polymers may be possible or desirable. The hydrophilic polymer or polymers are present at a level of about 0.001–5%, more preferably, about 0.001–1% of the liquid cleaner.

6. Chelating Agent

The chelating agent is also an important part of the invention. Chelants useful herein include the various alkali metal, ammonium and substituted ammonium polyacetates, carboxylates, polycarboxylates and polyhydroxysulfonates. Non-limiting examples of polyacetate and polycarboxylate builders include the sodium, potassium, lithium, ammonium and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These chelating agents may also exist either partially or totally in the hydrogen ion form, for example, citric acid or disodium dihydrogen ethylenediamine tetraacetate. The substituted ammonium salts include those from methylamine, dimethylamine, butylamine, butylenediamine, propylamine, triethylamine, trimethylamine, monoethanolamine, diethanolamine, triethanolamine, isopropanolamine, and propanolamine.

Other chelating agents, and dependent on the desired pH of the formulation (see below), are the mono-, di-, tri-, and tetrapotassium and ammonium salts of ethylenediamine tetraacetic acid. See, for example, Robbins et al., U.S. Pat. No. 5,972,876, Chang et al., U.S. Pat. No. 5,948,742, Ochomogo et al., U.S. Pat. No. 5,948,741, and Mills et al., U.S. Pat. No. 5,814,591

The amount of chelant added should be in the range of 0.001–2%, more preferably 0.001–2%, by weight of the cleaner.

7. Water

Since the cleaner is an aqueous cleaner with relatively low levels of actives, the principal ingredient is water, which should be present at a level of at least about 70%, more preferably at least about 80%, and most preferably, at least about 90%.

Distilled, deionized, or industrial soft water is preferred so as not to contribute to formation of a residue and to avoid the introduction of undesirable metal ions.

8. Solvents

A solvent may optionally be used which is generally a water soluble or dispersible organic solvent having a vapor pressure of at least 0.001 mm Hg at 25° C. A key attribute is that it should volatilize rapidly, such that it volatilizes no more than 5 minutes after contact with a surface, without leaving a residue. It is preferably selected from $C_{1-6}$ alkanols, $C_{1-6}$ diols, $C_{1-6}$ alkyl ethers of alkylene glycols and polyalkylene glycols, and mixtures thereof. The alkanol can be selected from methanol, ethanol, n-propanol, isopropanol, the various positional isomers of butanol, pentanol, and hexanol, and mixtures of the foregoing. It may also be possible to utilize in addition to, or in place of, said alkanols, the diols such as methylene, ethylene, propylene and butylene glycols, and mixtures thereof, and including polyalkylene glycols.

It is preferred to use a straight or branched chain alkanol as the coupling agent of the invention. These are methanol, ethanol, n-propanol, isopropanol, and the various positional isomers of butanol, pentanol, and hexanol. Especially preferred is isopropyl alcohol ("IPA"), also known as 2-propanol and, in the vernacular, "isopropanol." It is also preferred to use a mixture of an alkanol with a glycol ether, in which the ratio of the two components is about 100:1 to 1:10.

One can also use an alkylene glycol ether solvent in this invention. The alkylene glycol ether solvents can be used alone or in addition to the polar alkanol solvent. These can include, for example, monoalkylene glycol ethers such as ethylene glycol monopropyl ether, ethylene glycol mono-n-butyl ether, propylene glycol monopropyl ether, and propylene glycol mono-n-butyl ether, and polyalkylene glycol ethers such as diethylene glycol monoethyl or monopropyl or monobutyl ether, di- or tri-polypropylene glycol monomethyl or monoethyl or monopropyl or monobutyl ether, etc., and mixtures thereof. Additionally, acetate and propionate esters of glycol ethers can be used. Preferred glycol ethers are diethylene glycol monobutyl ether, also known as 2-(2-butoxyethoxy) ethanol, sold as Butyl Carbitol by Union Carbide, ethylene glycol monobutyl ether, also known as butoxyethanol, sold as Butyl Cellosolve also by Union Carbide, and also sold by Dow Chemical Co., propylene glycol monopropyl ether, available from a variety of sources, and propylene glycol methyl ether, sold by Dow as Dowanol PM. Another preferred alkylene glycol ether is propylene glycol t-butyl ether, which is commercially sold as Arcosolve PTB, by Arco Chemical Co. Dipropylene glycol n-butyl ether ("DPNB") is also preferred.

Short chain carboxylic acids, such as acetic acid, glycolic acid, lactic acid and propionic acid are also potential solvents, although their strong odor may require mitigation with a fragrance. Short chain esters, such as glycol acetate, or cyclic or linear volatile methylsiloxanes (such as from Dow Corning), may also be suitable for use.

Additional water insoluble solvents may be included in minor amounts (0–1%). These include isoparafinic hydrocarbons, mineral spirits, alkylaromatics, and terpenes such as d-limonene. Additional water soluble solvents may be included in minor amounts (0–2%). These include pyrrolidones, such as N-methyl-2-pyrrolidone, N-octyl-2-pyrrolidone and N-dodecyl-2-pyrrolidone.

It is preferred to limit the total amount of solvents to preferably no more than about 20%, and more preferably, no more than about 10%, of the cleaner. A particularly preferred range is about 1–5%. These amounts of solvents are generally referred to as dispersion-effective or solubilizing-effective amounts. The solvents, especially the glycol ethers, are also important as cleaning materials on their own, helping to loosen and solubilize greasy or oily soils from surfaces cleaned. But the volatile solvents, such as IPA, are necessary to prevent the leaving of residues on the surface cleaned.

9. Miscellaneous Adjuncts

Buffering and pH adjusting agents may be desirable components. These would include minute amounts of inorganic agents such as alkali metal and alkaline earth salts of silicate, metasilicate, borate, carbonate, carbamate, phosphate, ammonia, and hydroxide. Organic buffering agents such as monoethanolamine, monopropanolamine, diethanolamine, dipropanolamine, triethanolamine, and 2-amino-2-methylpropanol are also desirable.

Small amounts of adjuncts can be added for improving aesthetic qualities of the invention. Aesthetic adjuncts include fragrances or perfumes, such as those available from Givaudan-Rohre, International Flavors and Fragrances, Quest, Sozio, Firmenich, Dragoco, Norda, Bush Boake and Allen and others, and dyes or colorants which can be solubilized or suspended in the formulation. Further solubilizing materials, such as hydrotropes (e.g., water soluble salts of low molecular weight organic acids such as the sodium or potassium salts of xylene sulfonic acid), may also be desirable. Adjuncts for cleaning include additional surfactants, such as those described in *Kirk-Othmer, Encyclopedia of Chemical Technology*, 3rd Ed., Volume 22, pp. 332–432 (Marcel-Dekker, 1983), and *McCutcheon's Soaps and Detergents* (N. Amer. 1984), which are incorporated herein by reference. Dyes or colorants which can be solubilized or suspended in the formulation, such as diaminoanthraquinones, may be added, although it is cautioned that since leaving little or no residue is an objective of the invention, that only minute amounts should be used. Thickeners, such as polyacrylic acid, xanthan gum, alginates, guar gum, methyl, ethyl and propylhydroxycelluloses, and the like, may be desired additives, although the use of such polymers is to be distinguished from the previously mentioned hydrophilic polymers in 5 above. Defoamers, such as, without limitation, silicones, aminosilicones, silicone blends, silicone/hydrocarbon blends, and the like, available from Dow Corning, Wacker, Witco, Ross and Hercules.

The amounts of these aesthetic adjuncts should be in the range of 0–2%, more preferably 0–1%.

Other various adjuncts which are known in the art for detergent compositions can be added so long as they are not used at levels that cause unacceptable spotting/filming.

Additionally, because the surfactants in liquid systems are sometimes subject to attack from microorganisms, it is advantageous to add a mildewstat or bacteriostat. Exemplary mildewstats (including non-isothiazolone compounds) include Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3-diol, from Boots Company Ltd.; Proxel CRL, a propyl-p-hydroxybenzoate, from ICI PLC; Nipasol M, an o-phenylphenol, $Na^{30}$ salt, from Nipa Laboratories Ltd.; Dowicide A, a 1,2-benzoisothiazolin-3-one, from Dow Chemical Co.; and Irgasan DP 200, a 2,4,4'-trichloro-2-hydroxydiphenylether, from Ciba-Geigy A.G. See also, Lewis et al., U.S. Pat. No. 4,252,694 and U.S. Pat. No. 4,105,431, incorporated herein by reference. Other suitable preservatives include methyl, ethyl and propyl parabens, short chain organic acids (such as acetic, lactic and glycolic acids), bisguanidine compounds (e.g., Dantagard or Glydant) and the short chain alcohols mentioned in 8above can be bifunctional and also act as preservatives, such as ethanol and IPA.

EXPERIMENTAL

In the following experiments, a base inventive liquid cleaner to be impregnated on wipes was established. The formulation of the liquid cleaner was:

TABLE I

| | |
|---|---|
| Isopropyl Alcohol[1] | 3.0% |
| Glycol Ether[2] | 0.6% |
| APG Surfactant[3] | 0.1% |
| Polyacrylic Acid[4] | 0.05% |
| Deionized Water | (balance) |

[1]Solvent
[2]Dowanol PM - propylene glycol n-methyl ether (Dow Chemical Company)
[3]Glucopon APG 425 (Henkel KGaA)
[4]Acusol 445N (Rohm & Haas)

Table II depicts a thickened formula for the liquid cleaner:

TABLE II

| | |
|---|---|
| Isopropyl Alcohol[1] | 3.0% |
| Glycol Ether[2] | 0.6% |
| Hydroxyethylcellulose[5] | 0.25% |
| APG Surfactant[3] | 0.1% |
| Polyacrylic Acid[4] | 0.05% |
| Deionized Water | (balance) |

[5]Thickener, Naturesol 250HR (Hercules)

In the above Tables I and II, the polyacrylic acid is a hydrophilic polymer which can be substituted by various other materials, such as, without limitationpolyethylene glycol, and copolymers of acrylic acid and another comonomer. See also above, 5. Polymers.

The liquid cleaner of Tables I and II is then loaded onto a wipe, which is then referred to as a wet wipe. Wipes are typically made from fibrous sheet materials as described in 1. Substrate above. Examples of the substrates from which the wipes are made include:

TABLE III

| Manufacturer and Item | Description |
|---|---|
| DuPont 8838 and 8892 | Spunlaced pulp-polyester blends |
| Kimberly Clark Hydroknit | Spunlaced pulp-polypropylene |
| Kimberly Clark Spunbond | Spun, fine fiber polypropylene |
| Kimberly Clark Meltblown PP/EHRT | Meltblown polypropylene |
| American Nonwovens, ANC 4297 | Carded nonwoven, 70/30 Rayon/Polyester |
| American Nonwovens, ANC 4297 | Carded nonwoven, 100 Rayon |
| James River | Pulp or Pulp Blends |
| Dexter 10180 Hydrospun | Spunlaced Pulp Blend |

EXAMPLE 1

Filming and Streaking on Black Ceramic Tiles

In this test, the filming/streaking performance of wipes—such as described in Table II, to which a discrete amount of the liquid cleaner described in Table I was added, typically in an amount exceeding 100% of the weight of the wipe on a gram/gram basis—versus competitive products was compared. The test surfaces were black gloss tiles which had been initially cleaned with a 50/50 wt./wt. mixture of isopropyl alcohol/acetic acid. These tiles were then allowed to dry completely. The inventive wipes and the comparative products were then applied to individual tiles, using a Gardner Ware Tester. To ensure that the amount of liquid applied to each tile was at a maximum, the wipes were pinned to a sponge wrapped in plastic wrap and a one pound (454.54 grams) weight was placed on top of each wipe during the application of the liquid cleaner. Five strokes were used for each tile. The tiles were then allowed to dry completely and then were visually graded by an expert panel of over ten panelists. This was a blind test, in which the panelists did not know the identity of the products used to clean each mirror tile. They then graded each tile on a 0 to 10 scale, with 0 being dirty and 10 being completely clean and streak free. The results are depicted in Table IV:

TABLE IV

| Wipe Product | Visual Score (0 to 10 scale) |
|---|---|
| Invention | 9.83 |
| Invention (thickened) | 9.81 |
| Mr. Clean Bathroom Wipe-up[1] | 5.36 |
| Glorix[2] | 2.42 |
| Flash[3] | 2.63 |
| Water | 8.96 |
| HSD (error) | 1.09 |

[1]Procter & Gamble Co.
[2]Unilever (NL)
[3]Procter & Gamble Co. (UK)

As can be seen from the foregoing, the inventive wipes show dramatically superior performance over comparative products.

EXAMPLE 2

Filming and Streaking on Mirror Tiles

In the next set of examples, the inventive wipe was tested for performance on glass mirror tiles and compared to commercial products. In this test, the wipes were wiped over the mirrors and the mirrors allowed to dry. In a 0 to 10 scale, two standards were used: where a completely streaked mirror got a 0 grade, while a clean, nonstreaked mirror got a 10 grade. The test had multiple replicates with at least 10 expert panelists visually grading each mirror tile. This was a blind test, in which the panelists did not know the identity of the products used to clean each mirror tile. The confidence level for the test was 95%. The results are depicted below in Table V:

TABLE V

| Wipe Product | Visual Score (0 to 10 scale) |
|---|---|
| Invention | 8.73 |
| Invention (thickened) | 7.4 |
| Glorix | 1.6 |
| Flash | 0.93 |
| HSD | 2.32 |

Once again, it is demonstrated that the inventive wipes show dramatically superior performance versus comparative products.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A hard surface cleaning wipe which cleans surfaces without streaking and filming, said cleaning wipe comprising:

(a) a moist wipe which comprises at least one layer of absorbent or adsorbent material, said wipe impregnated with:

(b) a liquid cleaner which consists essentially of:

(i) a low residue surfactant;

(ii) a hydrophilic polymer selected from the group consisting of polysaccharides, polycarboxylates, polyvinyl alcohols, polyvinylpyrrolidones, polyethylene glycols, methylvinyl ethers, and mixtures thereof;

(iii) optionally, at least one adjunct selected from the group consisting of solvents, additional surfactants, cosurfactants, chelating agents, buffers, thickeners, dyes, colorants, biocides, fragrances, defoamers and mixtures thereof; and (iv) the remainder, water.

2. The wipe of claim 1 wherein said low residue surfactant is a nonionic surfactant.

3. The wipe of claim 2 wherein said nonionic surfactant is a glycoside.

4. The cleaning wipe of claim 1 wherein the hydrophilic polymer of (b)(ii) is a polycarboxylate.

5. The cleaning wipe of claim 4 wherein the polycarboxylate is a polyacrylate.

6. The wipe of claim 1 wherein at least one said adjunct is present in said liquid cleaner.

7. A method for cleaning a hard surface comprising:

contacting said surface with a hard surface cleaning wipe according to claim 1.

8. A dispenser for hard surface cleaning wipes comprising a container with a plurality of said hard surface cleaning wipes according to claim 1 therein.

9. The dispenser of claim 8 wherein said plurality of wipes comprise a continuous web of nonwoven material.

10. The dispenser of claim 9 further comprising means for sizing an individual wipe from said continuous web.

11. The dispenser of claim 8 wherein said plurality of wipes comprise a series of individual sheets of nonwoven material.

* * * * *